US005769418A

United States Patent [19]

Gilbert et al.

[11] Patent Number: 5,769,418

[45] Date of Patent: Jun. 23, 1998

[54] TRANSPARENT PUZZLE HAVING AT LEAST TWO IMAGE PLANES

[76] Inventors: Daniel B. Gilbert, 261 Ricardo Rd.; Walter L. Good, III, 493 Lovell Ave., both of Mill Valley, Calif. 94941

[21] Appl. No.: 763,470

[22] Filed: Dec. 11, 1996

[51] Int. Cl.[6] ..... A63F 9/12

[52] U.S. Cl. ..... 273/157 A; 273/153 S

[58] Field of Search ..... 273/153 S, 157 R, 273/157 A

[56] References Cited

U.S. PATENT DOCUMENTS

| | | | |
|---|---|---|---|
| 922,002 | 5/1909 | Koehler et al. . | |
| 961,892 | 6/1910 | Peck . | |
| 979,923 | 12/1910 | Boore et al. . | |
| 1,017,592 | 2/1912 | Hardy . | |
| 1,101,567 | 6/1914 | Ridgeway . | |
| 3,107,918 | 10/1963 | Edlen | 273/157 A |
| 3,606,335 | 9/1971 | Reiner et al. | 273/157 A |
| 3,788,645 | 1/1974 | Nelson . | |
| 3,892,411 | 7/1975 | High . | |
| 3,923,307 | 12/1975 | Sukys et al. . | |
| 4,410,180 | 10/1983 | Clark . | |
| 4,474,371 | 10/1984 | Silbermintz . | |
| 4,586,714 | 5/1986 | Lenkoff et al. . | |
| 4,799,680 | 1/1989 | Weimar | 273/157 A |
| 4,811,951 | 3/1989 | Dorsey-Zinn et al. | 273/157 R |
| 4,815,742 | 3/1989 | Augustine | 273/157 A |
| 4,824,098 | 4/1989 | Huang . | |
| 4,838,551 | 6/1989 | Volpert | 273/157 R |
| 4,861,036 | 8/1989 | Watanabe . | |
| 5,267,732 | 12/1993 | Bowen et al. | 273/153 S |
| 5,310,184 | 5/1994 | Grist . | |
| 5,407,201 | 4/1995 | Whitehurst . | |

*Primary Examiner*—Steven B. Wong
*Attorney, Agent, or Firm*—Donald L. Beeson

[57] ABSTRACT

A puzzle has a transparent top layer and a bottom layer which can be seen through the top layer. The top layer of the puzzle is provided with a top image and the bottom layer with a bottom image which is associated with this top image. When viewed through the transparent top layer both top and bottom images are seen as a composite image. At least one of the top and bottom layers include a plurality of image elements moveable relative to each other to produce at least one desired composite image which is the solution to the puzzle. For added complexity, both top and bottom layers may include moveable image elements which are manipulated from opposite sides of the puzzle. The puzzle is particularly adapted to slide puzzles having two layers of slide tiles.

11 Claims, 6 Drawing Sheets

TRANSPARENT PUZZLE HAVING AT LEAST TWO IMAGE PLANES

BACKGROUND OF THE INVENTION

The present invention generally relates to the art of puzzles, and more particularly relates to the type of puzzle where a desired image is formed by the proper positioning of a plurality of scrambled puzzle pieces. It will be seen that the invention has specific application in connection with so-called "slide puzzles" wherein individual tiles pieces can be moved one at a time within a frame to achieve a desired ordering of tiles.

It is well known to provide puzzles having a plurality of individual puzzle pieces with border indicia that are intended to match border indicia of other puzzle pieces when the puzzle pieces are properly configured or assembled. Generally, the objective of such puzzles is to manipulate the puzzle pieces to achieve a certain desired image or combination of images on a planar image surface, with the complexity of the puzzle being dependent on the complexity and intricacy of the image design. It is known to provide such puzzles in both two and three dimensional designs involving, respectively, two and three dimensional puzzle pieces. An example of a two dimensional design is disclosed in U.S. Pat. No. 3,923,307 which discloses a puzzle comprising a flat sheet of paper divided into separable sections and having border indicia that can be matched when the sections are separated and reassembled. An example of a three dimensional puzzle is disclosed in U.S. Pat. No. 5,407,201 wherein pyramid-shaped blocks have border indicia along each of their edges that match border indicia on the edges of other blocks, and wherein individual blocks can be assembled into a larger pyramid shape having desired images formed on each face of the pyramid.

Another well-known concept involving the arrangement of individual puzzle pieces into a desired solution is a slide puzzle wherein a plurality of square tiles are set into a frame such that the tiles can be repositioned by moving the tiles one at a time into a free space left by a previously moved tile. A popular example of such a slide puzzle is to imprint consecutive numbers on the tiles such that the solution of the puzzle involves reordering scrambled tiles until they are arranged in increasing numerical order.

Yet another example of a puzzle involving the proper positioning of matching pieces is disclosed in U.S. Pat. No. 4,586,714 wherein scrambled square tiles, each of which has a portion of an overall image, can be set into a visible grid on a frame to produce the desired image solution for the puzzle.

In the above-described prior art puzzles, the desired images or arrangement of indicia are created on a single image plane, or in the case of three dimensional puzzles, on a series of single image planes that intersect at various angles, depending upon the shape of the three dimensional puzzle. In either case, the puzzle images are created by matching the image or indicia of one puzzle piece with adjacent puzzle pieces to form a desired total image. The present invention provides a puzzle wherein a desired image on any given image plane involves not only the proper contiguous arrangement of scrambled puzzle pieces, but also the superposition of puzzle pieces from at least two different image surfaces or layers. The present invention thus provides for greater variety and interest in creating puzzle solutions as compared to conventional matching puzzles. The invention also uniquely provides the capability of extending a puzzle's complexity to challenge the most ardent puzzle enthusiast by adding a dimension of complexity to the puzzle's solution.

SUMMARY OF THE INVENTION

Briefly, the invention involves a puzzle having an image plane on which a desired composite image is created from at least two superimposed images. In accordance with the invention, a transparent top layer having a top image is provided above a bottom layer having a bottom image associated with the puzzle's top image. At least one of the top and bottom layers includes a plurality of image elements which can be moved relative to each other until a desired solution to the puzzle is achieved, a solution which will be in the form of a desired composite between the puzzle's superimposed top and bottom images as seen through the transparent top layer of the puzzle. For added complexity, both layers of the puzzle can include movable image elements such that the desired solution can only be achieved upon the proper manipulation and arrangement of two separate sets of image elements.

The invention can incorporate a number of puzzle formats including the creation of a diorama wherein foreground figures on the transparent top layer of the puzzle are superimposed over background scenery. Another puzzle format is to provide matching figures on both of the top and bottom layers of the puzzle whereby the solution of the puzzle involves manipulating puzzle pieces such that figures on the transparent top layer cover the background figures on the bottom layer of the puzzle. Yet another puzzle format is to provide foreground partial figures on the transparent top layer and background partial figures on the bottom layer which are complimentary to the partial figures on the top layer. With such a format, the solution to the puzzle involves the manipulation of puzzle pieces until the foreground partial figures match the background partial figures to form desired completed figures.

It is therefore a primary object of the present invention to provide a puzzle having an added dimension of interest and complexity. It is another object of the invention to provide a puzzle having a three dimensional solution in a single image plane. It is still a further object of the invention to provide a puzzle that is adaptable to a number of puzzle formats having different levels of complexity. Other objects of the invention will be apparent from the following specification and claims.

DETAILED DESCRIPTION OF THE ILLUSTRATED EMBODIMENT

In the present invention, a puzzle is provided having an image plane in which the solution to the puzzle involves manipulating movable image elements to create a desired image. The puzzle, which involves at least two image layers, is particularly adapted to a slide puzzle which is described and illustrated herein. However, it will be understood that the invention can be adapted to any puzzle construction or format involving the superposition of top and bottom images to create a composite solution in the manner described and illustrated.

Figure 1:
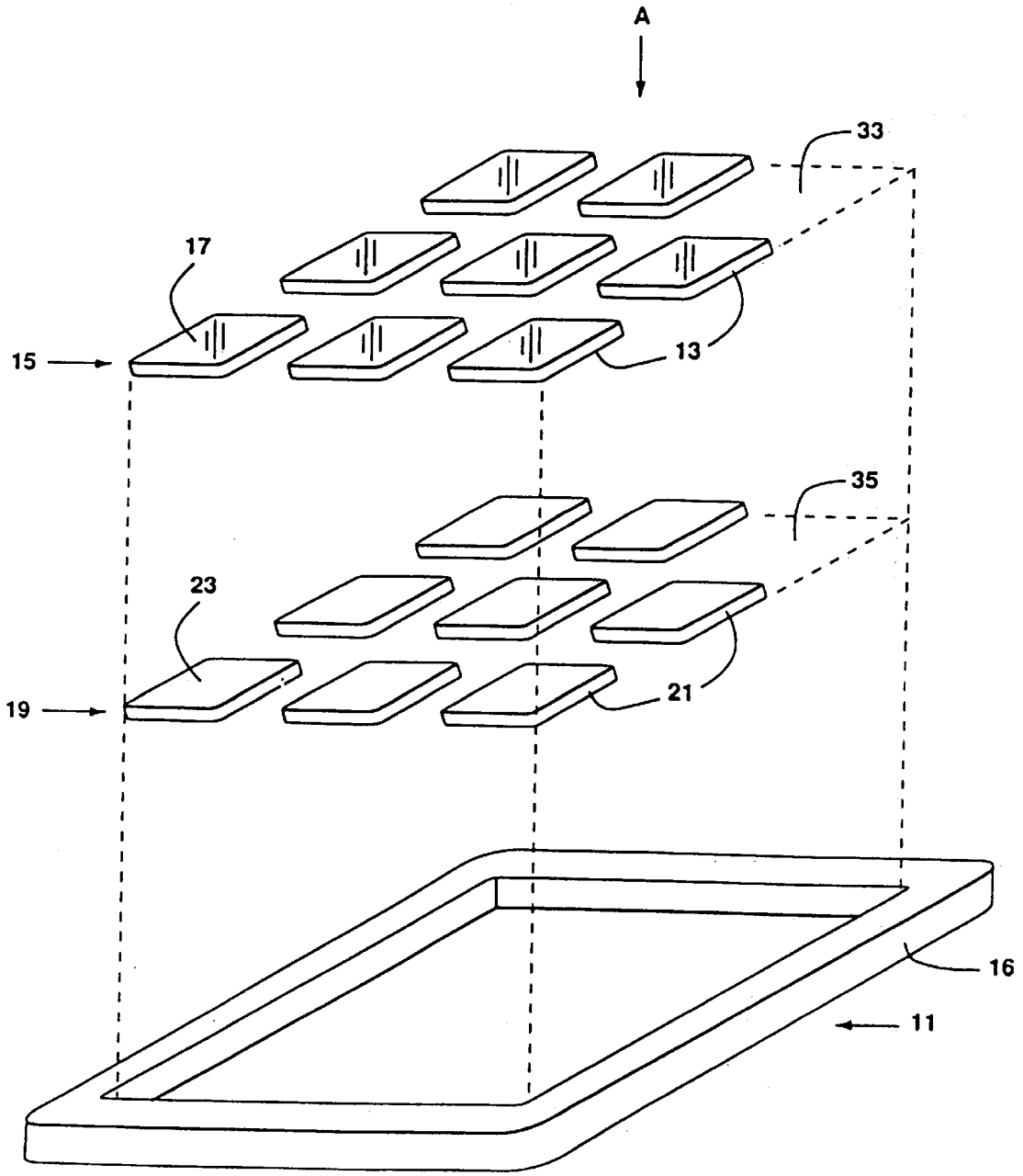
FIG. 1 is an exploded perspective view which pictorially shows the construction of an embodiment of the invention using slide tiles.

Turning now to the drawings, the slide puzzle 11 pictorially illustrated in FIG. 1 has a first set of image elements in the form of square transparent slide tiles 13 which form a transparent top layer 15 having a top image surface 17. A bottom layer 19 is provided by means of a second set of image elements, in this case square tiles 21, which are preferably opaque and which provide a bottom image surface 23 beneath the puzzles top image surface. The two sets of tiles 13, 21 are slidably held in an open rectangular frame 16 which has a thickness sufficient to accommodate and hold both sets of tiles and which permits the top set of tiles to be manipulated from one side of the frame and the bottom set of tiles to be manipulated from the other. It will be appreciated that, because the tiles of top layer 15 are transparent, any image on bottom image surface 23 can be seen through the top layer when the puzzle is viewed from above as generally denoted by arrow A. As further described below, the illustrated puzzle will have a solution consisting of a desired arrangement of both the first and second sets of tiles which will produce a desired composite of top and bottom images on the two layers of the puzzle.

Figure 2:
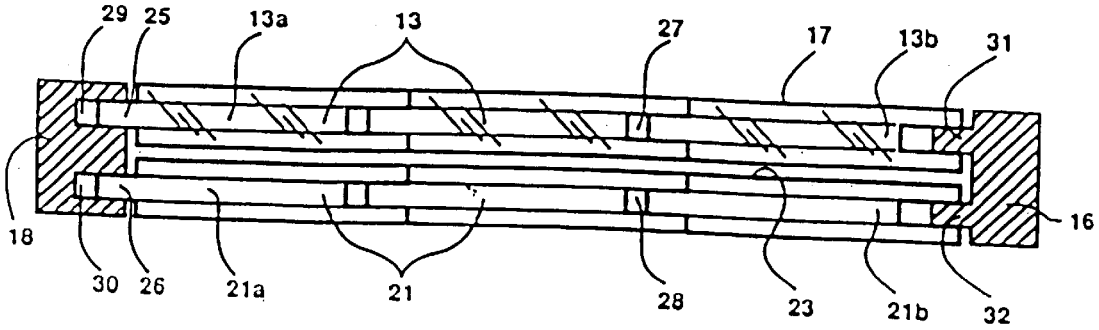
FIG. 2 is an enlarged cross-sectional view, in side elevation, of a puzzle such as pictorially shown in FIG. 1.

FIG. 2 illustrates a specific construction of the slide puzzle shown pictorially in FIG. 1 wherein the top layer of transparent tiles 13 and the bottom layer of opaque tiles 21 are slidably held within the perimeter sidewalls 18 frame 16 by means of an interlocking tongue and groove design. Specifically, it is seen that tiles 13, 21 of the bottom and top layer of tiles are identically shaped and constructed, with each tile having a projecting tongue 25, 26 on one side of the tile which fits into and slides within a groove 27, 28 provided in the opposite side of contiguous tiles. The frame 15 is correspondingly provided with interior top and bottom grooves 29, 30 on one side of the frame and top and bottom projecting tongues 31, 32 on the other side of the frame for slidably engaging the tongues and grooves of perimeter tiles 13*a*, 21*a*, and 13*b*, 21*b*. A free space 33, 35 is provided in each set of tiles as shown in FIG. 1 such that the tiles within each layer can be moved one at a time into a free space created by a previously moved tile and such that tiles within a layer can, by successive moves, be rearranged within the layer to any position within the layer. As the tiles are thusly manipulated, desired images and superposition of images can be accomplished on top and bottom image surfaces 17, 23.

Figure 3:
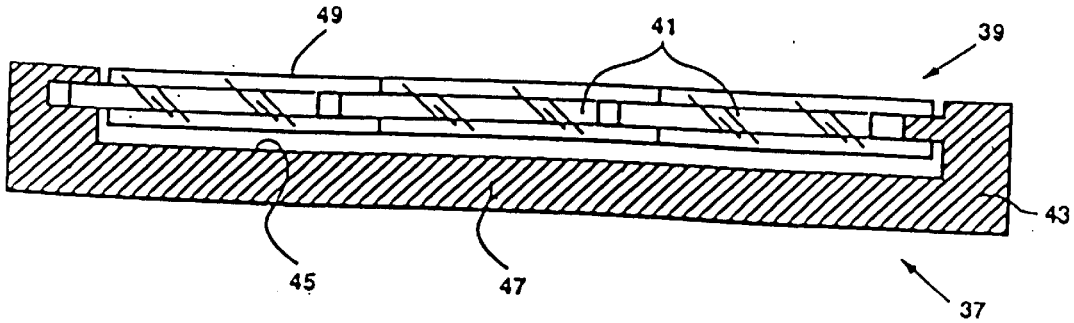
FIG. 3 is a cross-sectional view, in side elevation, of an alternative design of the puzzle shown in FIG. 2 wherein the bottom layer of the puzzle provides a fixed image surface.

FIG. 3 shows an alternative to the slide puzzle construction illustrated in FIG. 2. In the FIG. 3 construction, slide puzzle 37 has a top layer 39 which consists of transparent tongue and groove tiles 41 slidably held in frame 43 in the same manner as the top layer of tiles 13 are held in the frame 16 of the FIG. 2 embodiment. However, in the FIG. 3 embodiment, the bottom image surface 45, instead of being provided by movable tiles, is provided by the opaque bottom wall 47 of frame 43. Thus, the frame's bottom wall provides an effective bottom layer of the puzzle which can be seen through transparent tiles 41. A puzzle solution is achieved by arranging the transparent tiles 41 to produce a desired image on top image surface 49 which, in turn, forms a composite image with the fixed image on bottom image surface 45. It can readily be appreciated that a puzzle in accordance with the FIG. 3 embodiment would be easier to solve than the FIG. 2 puzzle since it involves the manipulation of tiles in a single layer only.

Figure 3A:
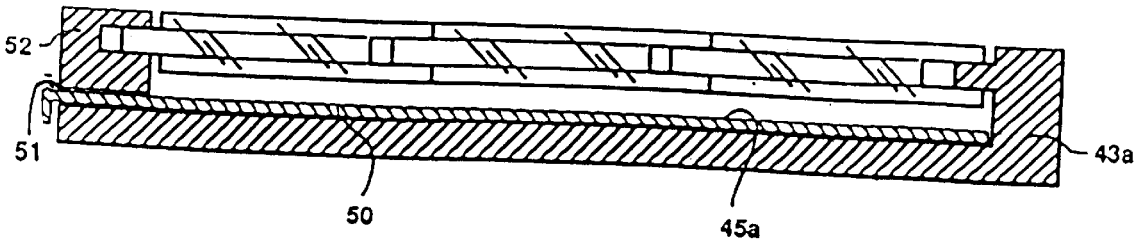
FIG. 3A is a cross-sectional view of the frame of a puzzle such as shown in FIG. 3 having replaceable bottom image panels.

FIG. 3A shows an alternative to the fixed bottom wall embodiment of FIG. 3 wherein bottom image surface 45*a* is provided by means of a replaceable image panel 50 which is inserted into frame 43*a* through a panel insert slot 51 cut into one of the frame's perimeter side walls 52 so as to extend transversely across the one side of the frame below puzzle's top layer of tiles 13. By providing replaceable image panels, the fixed bottom image of the puzzle that is seen through the puzzle's top transparent layer can be changed, not only to change the puzzle art but also to change the level of difficulty of the puzzle. Image panels 50 can be fabricated of any planar material of suitable stiffness to insert into the puzzle, and on which a suitable image can be imprinted.

Figure 4A:
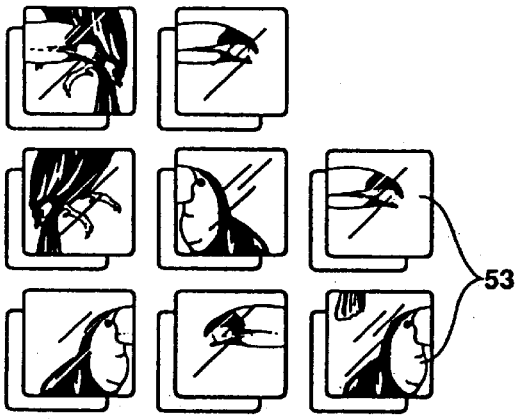
FIG. 4A is an exploded top plan view of a scrambled first set of movable image elements forming a top transparent layer of a puzzle in accordance with the invention.
Figure 4B:
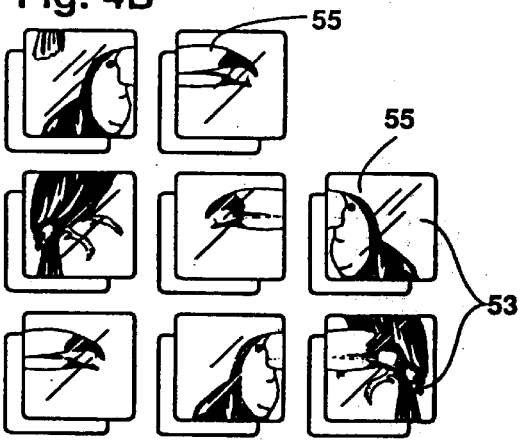
FIG. 4B is an exploded top plan view of the first set of image elements shown in FIG. 4A arranged to create a desired top image thereon.
Figure 4C:
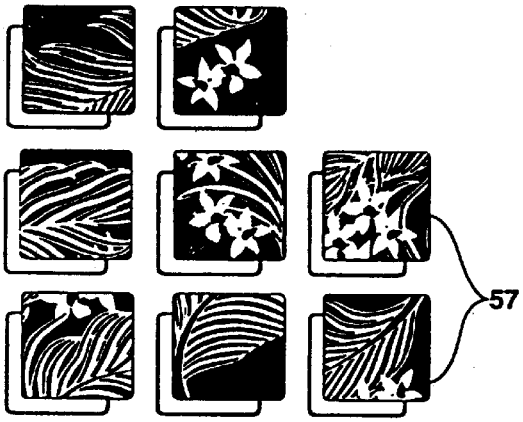
FIG. 4C is an exploded top plan view of a scrambled second set of movable image elements forming an opaque bottom layer of a puzzle in accordance with the invention.
Figure 4D:
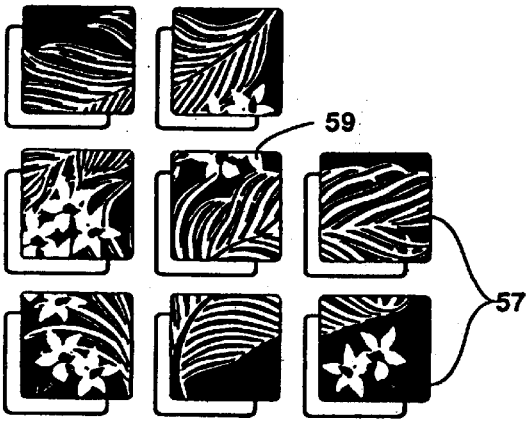
FIG. 4D is an exploded top plan view of the second set of movable image elements shown in FIG. 4C arranged to create a desired bottom image thereon.
Figure 4E:
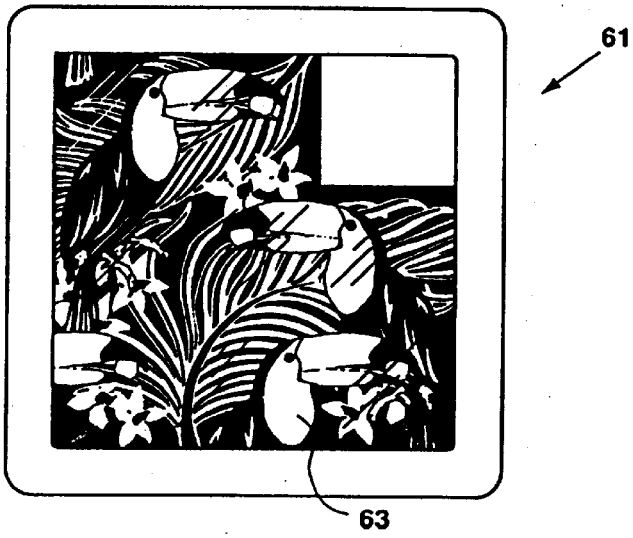
FIG. 4E is a top plan view of a puzzle in accordance with the invention having top and bottom layers comprised of the image elements shown in FIGS. 4A and 4C and showing the composite of the top and bottom images on such puzzle layers as seen through the top transparent layer of the puzzle.

A diorama version of the puzzle of the present invention is shown in FIGS. 4A–4E wherein a first set of transparent tiles 53 arranged from a scrambled condition as shown in FIG. 4A to an unscrambled condition as shown in FIG. 4B provides a top foreground image in the form of a group of toucans 55, and wherein a second set of tiles 57 which are arranged from a scrambled condition as shown in FIG. 4C to an unscrambled condition as shown in FIG. 4D provides a bottom image in the form of jungle scenery 59 in which the toucans 55 are seated. FIG. 4E shows puzzle 61 with the composite image 63 formed by the foreground and background images separately shown in FIGS. 4B and 4D.

Figure 5A:
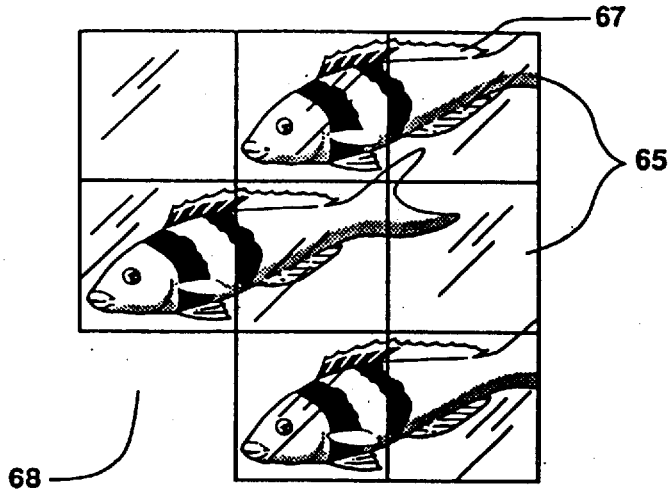
FIGS. 5A–5C are top plan views of the top, bottom, and composite layers of a puzzle in accordance with the invention showing an example of a diorama format.
Figure 5B:
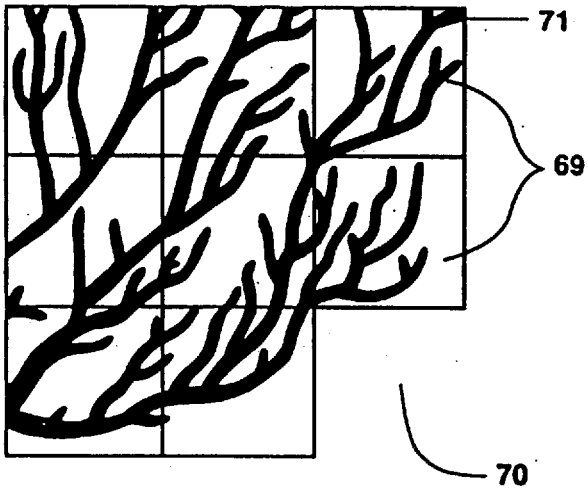
Figure 5C:
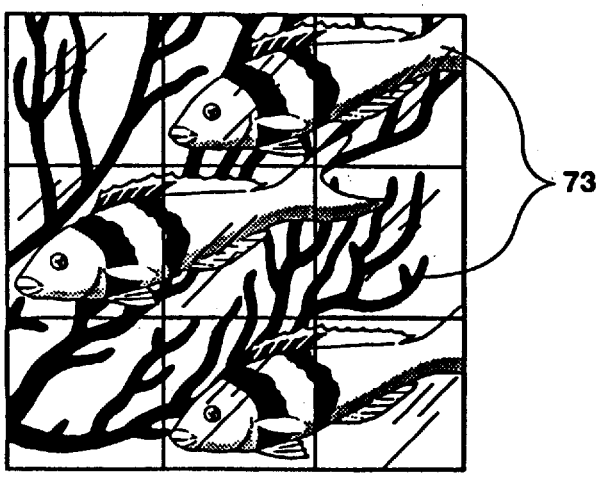

FIGS. 5A–5C show a pictorial representation of an alternative diorama format for the puzzle of the invention wherein the top layer of transparent tiles 65 shown in FIG. 5A has a top image consisting of a group of fish 67, and the bottom layer of tiles 69 shown in FIG. 5B has an image consisting of an underwater plant 71. In FIG. 5C a composite image 73 is formed between the foreground school of fish and background underwater plant life. It is noted that unlike the toucan diorama shown in FIGS. 4A–4E, the free spaces 68, 70 in the top and bottom layer of the puzzle shown in FIGS. 5A–5C do not overlap when the tiles are arranged to their proper solution, thus providing a composite image that fills the entire area of the puzzle without void spaces.

Figure 6A:
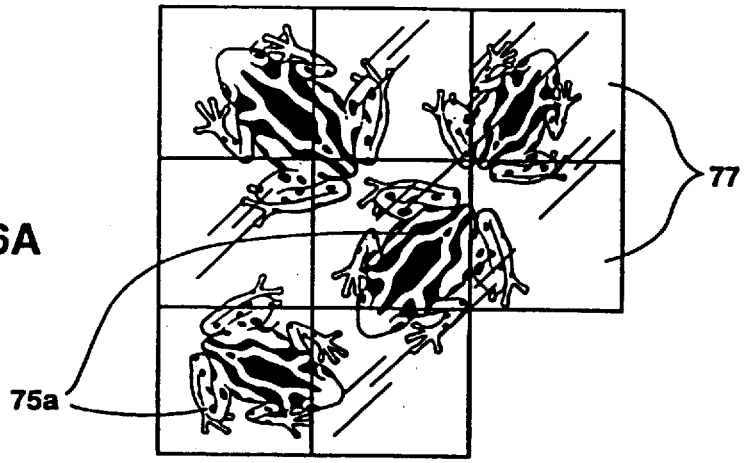
FIGS. 6A–6C are top plan views of the top, bottom, and composite layers of a puzzle in accordance with the invention showing a format involving the matching of figures on the top layer with identical figures on the bottom layer of the puzzle.
Figure 6B:
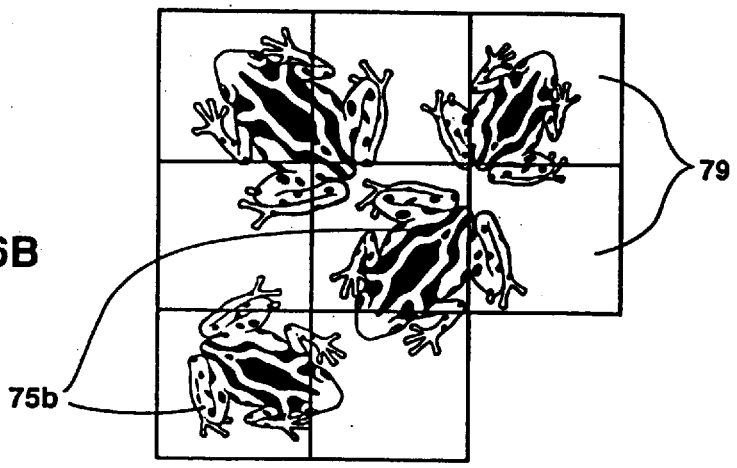
Figure 6C:
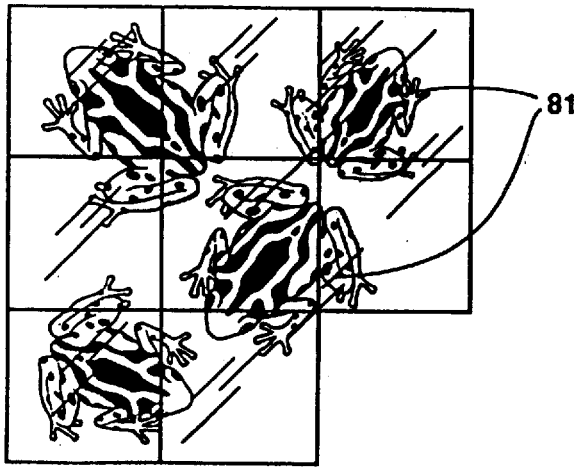

In the embodiment illustrated in FIGS. 6A–6C, the top and bottom images include matching foreground and background figures in the form of matching frog illustrations 75*a* and 75*b*. When the top transparent tiles 77 and bottom tiles 79 are properly arranged, the foreground frog figures 75*a* will cover the background frog figures 75*b* to produce the composite image 81 shown in FIG. 6C.

Figure 7A:
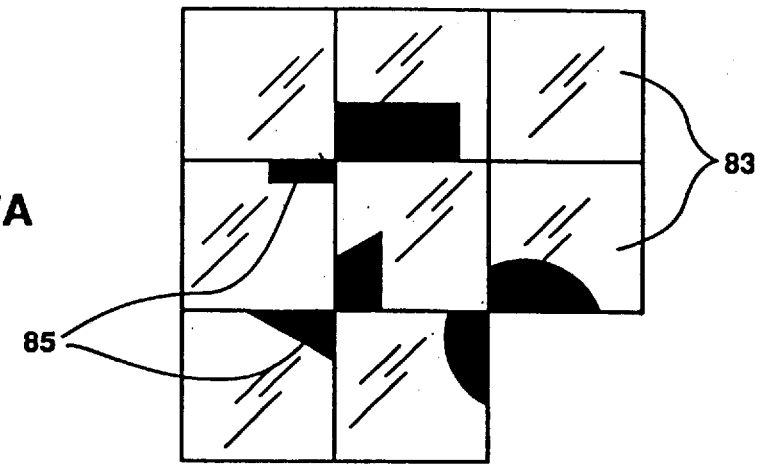
FIGS. 7A–7C are top plan views of the top, bottom, and composite layers of a puzzle in accordance with the invention showing the format of matching partial figures on the top layer with partial figures on the bottom layer to achieve desired completed figures which are the puzzle solution.
Figure 7B:
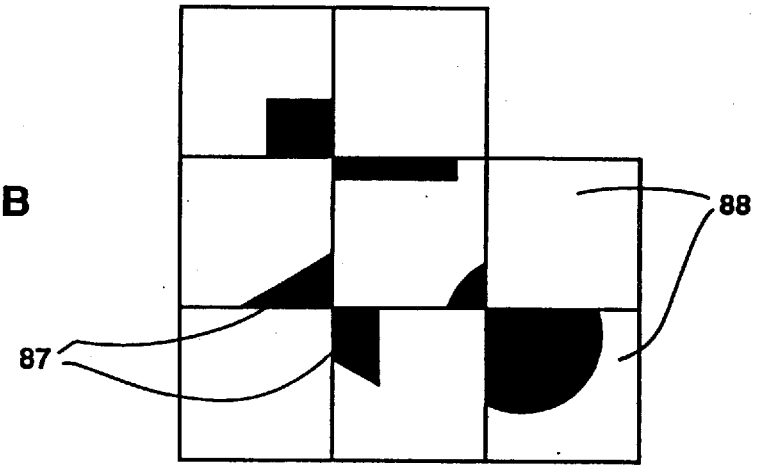
Figure 7C:
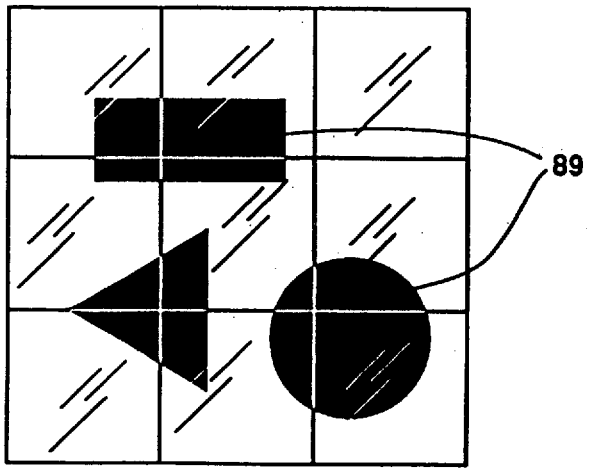

Referring to FIG. 7A–7C, a version of the puzzle is shown wherein the top set of transparent tiles 83 includes foreground partial figures in the form of partial geometric shapes 85 (shown in FIG. 7A), and wherein the bottom set of 88 opaque tiles (shown in FIG. 7B) includes background partial figures in the form of partial geometric shapes 87 that are complementary to the partial geometric shapes 85 on the top layer of tiles shown in FIG. 7A. The proper solution for the embodiment shown in FIGS. 7A–7C requires the arrangement of the bottom and top layer of tiles to a position where the foreground partial figures match the background partial figures to form completed geometric shapes 89 as shown in FIG. 7C. This format generally has a higher degree of difficulty than the formats shown in FIGS. 5A–5C and FIGS. 6A–6C.

It will be appreciated that a wide variety of formats can be devised for use with puzzles made in accordance with the present invention wherein a background image, which can be seen through a top transparent layer of the puzzle, will, upon solving the puzzle, match a foreground image in a desired fashion. It will also be appreciated that puzzles in accordance with the invention can be constructed having varying complexities by varying the number of image elements forming the puzzle's top and bottom layers. Image elements that can be rearranged other than by sliding are further possible.

Thus, it can be seen that the present invention provides for a unique puzzle that provides for additional dimensions of enjoyment and complexity by providing two visible superimposed image surfaces wherein one or both of the image surfaces can be configured to produce a composite image as the solution to the puzzle. While the present invention has been described in considerable detail in the foregoing specification and the accompanying drawings, it is understood that it is not intended that the invention be limited to such detail, except as necessitated by the following claims.

What we claim is:

1. A slide puzzle comprising a frame having a top image plane and a bottom image plane beneath said top image plane, and a first set of regularly shaped tiles slidably held in a top image plane in said frame and having at least one free space such that the tiles of said first set of tiles may be slidably moved relative to each other in said top image plane to any position within said frame, each of said tiles providing at least a portion of a top image formable in said top image plane by the proper positioning of said tiles, said bottom image plane having a bottom image therein that is associated with the formable top image in said top image plane, and said first set of tiles being transparent such that said bottom image plane can be seen through said first set of tiles and such that a desired composite image constituting a desired solution to the puzzle is formed by said formable top image and said bottom image only upon proper manipulation of said first set of tiles within said frame.

2. The puzzle of claim 1 wherein said frame has a bottom wall and said bottom wall provides the bottom image plane of the puzzle.

3. The puzzle of claim 1 wherein the bottom image in said bottom image plane is provided by a replaceable image panel insertable into said frame whereby the bottom image of the puzzle can be changed to change the composite image formed by said top and bottom images.

4. The puzzle of claim 1 wherein a second set of regularly shaped tiles are slidably held in the bottom image plane of said frame, the tiles of said second set of tiles being slidably movable relative to each other in said frame to any position within said image plane, each of said tiles providing at least a portion of a bottom image formable in said bottom image plane by the proper manipulation of said tiles, wherein a desired composite image constituting a desired solution to the puzzle is formed by said formable top and bottom images only upon proper manipulation of both said first and second set of tiles within said frame.

5. The puzzle of claim 1 wherein the formable top image on said first set of tiles includes foreground figures and said bottom image includes background scenery whereby, when the tiles of said first set of tiles are moved to a desired solution, a desired composite diorama is formed comprised of said foreground figures and background scenery.

6. The puzzle of claim 4 wherein the formable top image on said first set of tiles includes foreground figures and the formable bottom image on said second set of tiles includes background scenery whereby, when the tiles of said first and second sets of tiles are both moved to a desired solution, a desired composite diorama is formed comprised of said foreground figures and background scenery.

7. The puzzle of claim 1 wherein the formable top image on said first set of tiles includes foreground figures and said bottom image includes matching background figures whereby, when the tiles of said first set of transparent tiles are moved to a desired solution, the foreground figures cover the background figures.

8. The puzzle of claim 4 wherein the formable top image on said first set of tiles includes foreground figures and the formable bottom image on said second set of tiles includes matching background figures whereby, when the tiles of said first and second sets of tiles are moved to a desired solution, the foreground figures cover the background figures.

9. The puzzle of claim 1 wherein the formable top image on said first set of tiles includes at least one foreground partial figure and said bottom image includes a background partial figure which is complimentary to the partial figure of said top image such that, when the tiles of said first set of tiles are moved to a desired solution, the foreground partial figure matches the background partial figure to form a completed figure.

10. The puzzle of claim 4 wherein the formable top image on said first set of tiles includes at least one foreground partial figure and the formable bottom image on said second set of tiles includes a background partial figure which is complimentary to the partial figure of said top image such that, when the tiles of said first and second sets of tiles are both moved to a desired solution, the foreground partial figure matches the background partial figure to form a completed figure.

11. A puzzle comprising a top layer defining a top image plane, and a bottom layer defining a bottom image plane, said top and bottom layers each including a plurality of regularly shaped image elements movable to any position relative to each other so that at least one formable image can be produced in each of said top and bottom image planes upon the proper manipulation of said image elements, and the top layer of the puzzle being transparent such that the bottom layer can be seen through said top layer and such that a desired composite image constituting a desired solution to the puzzle is formed by said formable top image and formable bottom image only upon proper manipulation of the image elements of both the top and bottom layers of the puzzle.

* * * * *